US009803949B2

(12) United States Patent
Troy, Jr.

(10) Patent No.: US 9,803,949 B2
(45) **Date of Patent: *Oct. 31, 2017**

(54) RAIL COVER FOR A FIREARM

(71) Applicant: Stephen P. Troy, Jr., Lee, MA (US)

(72) Inventor: Stephen P. Troy, Jr., Lee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/202,082

(22) Filed: Jul. 5, 2016

(65) Prior Publication Data

US 2016/0313083 A1 Oct. 27, 2016

Related U.S. Application Data

(62) Division of application No. 14/599,212, filed on Jan. 16, 2015, now Pat. No. 9,395,138, which is a division of application No. 12/710,130, filed on Feb. 22, 2010, now Pat. No. 8,935,874.

(60) Provisional application No. 61/154,346, filed on Feb. 20, 2009.

(51) Int. Cl.

| | |
|---|---|
| ***F41C 23/16*** | (2006.01) |
| ***F41A 35/02*** | (2006.01) |
| ***F41C 27/00*** | (2006.01) |
| ***F41G 11/00*** | (2006.01) |

(52) U.S. Cl.

CPC ..... *F41A 35/02* (2013.01); *F41C 23/16* (2013.01); *F41C 27/00* (2013.01); *F41G 11/003* (2013.01)

(58) Field of Classification Search

CPC ..... F41C 23/00; F41C 23/14; F41C 23/16; F41C 27/00; F41A 35/00; F41G 1/387; F41G 1/41; F41G 1/16; F41G 1/28

USPC ..... 42/90, 96, 124–127, 148, 71.01, 72, 74, 42/85

See application file for complete search history.

(56) References Cited

U.S. PATENT DOCUMENTS

| | | | | |
|---|---|---|---|---|
| 3,877,166 A * | 4/1975 | Ward | F41G 11/003 | 42/127 |
| 6,185,854 B1 * | 2/2001 | Solinsky | F41G 1/35 | 362/110 |
| 6,192,643 B1 * | 2/2001 | Zadok | E04B 1/0046 | 52/204.1 |
| 6,574,901 B1 * | 6/2003 | Solinsky | F41G 11/003 | 362/110 |
| 6,725,594 B2 * | 4/2004 | Hines | F41A 35/02 | 42/124 |
| 6,782,652 B1 * | 8/2004 | Erickson | F41A 35/02 | 42/124 |
| 7,188,978 B2 * | 3/2007 | Sharrah | F21S 9/02 | 248/216.4 |
| 7,243,454 B1 * | 7/2007 | Cahill | F41C 23/12 | 42/72 |
| 7,260,912 B2 * | 8/2007 | Liu | F41G 11/003 | 42/124 |

(Continued)

*Primary Examiner* — Jonathan C Weber
(74) *Attorney, Agent, or Firm* — Parsons & Goltry; Robert A. Parsons; Michael W. Goltry

(57) ABSTRACT

A rail cover for use on a handcover having a rail. The rail cover includes a body having opposing side edges, a top surface and a bottom surface. Parallel sidewalls depend from the bottom surface to define a socket therebetween for slidably engaging the rail of the handguard. A snap clip is carried by the body and is movable between a raised position for allowing sliding engagement with a rail of a handguard and a lowered position wherein a portion thereof is received within a slot of the handguard and prevents sliding engagement thereof.

8 Claims, 12 Drawing Sheets

(56) References Cited

U.S. PATENT DOCUMENTS 7,523,583 B2 * 4/2009 Cheng ..... F41G 1/35 362/110
7,562,483 B2 * 7/2009 Hines ..... F41G 11/003 42/71.01
D667,917 S * 9/2012 Fitzpatrick ..... D22/108
D668,731 S * 10/2012 Fitzpatrick ..... D22/108
8,371,729 B2 * 2/2013 Sharrah ..... F21S 9/02 362/439
8,650,793 B1 * 2/2014 Mendez ..... F41G 11/003 42/90
8,875,434 B2 * 11/2014 Michal ..... F41C 23/16 42/90
8,935,874 B2 * 1/2015 Troy ..... F41A 35/02 42/90
D730,474 S * 5/2015 Ding ..... D22/108
9,115,955 B2 * 8/2015 Barnhart ..... F41C 23/16
9,395,138 B2 * 7/2016 Troy, Jr. ..... F41A 35/02
2003/0106252 A1 * 6/2003 Hines ..... F41A 35/02 42/90
2004/0064994 A1 * 4/2004 Luke ..... F41C 23/16 42/85
2006/0075672 A1 * 4/2006 Romer ..... F41G 11/003 42/10
2007/0193103 A1 * 8/2007 Cheng ..... F41G 11/003 42/111
2008/0190002 A1 * 8/2008 Hines ..... F41G 11/003 42/1.06
2009/0241397 A1 * 10/2009 Fitzpatrick ..... F41C 23/16 42/90
2010/0236124 A1 * 9/2010 Troy ..... F41A 35/02 42/90
2012/0085013 A1 * 4/2012 Cahill ..... F41A 35/02 42/96
2012/0266514 A1 * 10/2012 Michal ..... F41C 23/16 42/90
2015/0128470 A1 * 5/2015 Troy, Jr. ..... F41A 35/02 42/90

* cited by examiner

RAIL COVER FOR A FIREARM

CROSS-REFERENCE TO RELATED APPLICATION

This application is a Divisional Application of pending U.S. application Ser. No. 14/599,212, filed 16 Jan. 2015, which claims the benefit of U.S. application Ser. No. 12/710,130, filed 22 Feb. 2010, now issued as U.S. Pat. No. 8,935,874, which claims the benefit of U.S. Provisional Application No. 61/154,346, filed 20 Feb. 2009.

FIELD OF THE INVENTION

This invention relates to firearm accessories.

More particularly, the present invention relates to rail covers for attachment to those handguards of firearms having rails.

BACKGROUND OF THE INVENTION

In the field of firearms, many currently employ handguards surrounding the barrel and positioned against or proximate the forward end of a receiver. These handguards often include rails for mounting accessories such as sights, optics, lights, lasers, vertical grips, and the like. In the past, the rail was mounted on the top surface of the handguard, and did not interfere with a shooters grip. Currently, many handguards includes rails formed on the sides and bottom thereof. These rails, when not in use to carry accessories, can interfere with a shooters grip. Additionally, rails systems such as the Picatinny rail or the Weaver style rail system should be covered for protection to prevent damage. Damage to a rail can interfere with the attachment or use of accessories. To overcome this problem, rail covers have been developed to essentially cap the rails, smoothing them out to provide a better grip for a shooter and protecting the edges from damage. While effective, current rail covers are often insecurely mounted to a rail. They can slide and move when gripped, or fall off if jarred or hooked.

It would be highly advantageous, therefore, to remedy the foregoing and other deficiencies inherent in the prior art.

An object of the present invention is to provide a secure and easily installed rail cover.

SUMMARY OF THE INVENTION

Briefly, to achieve the desired objects and advantages of the instant invention provided is a rail cover for use on a handguard having a rail. The rail cover includes a body having opposing first and second side edges, a top surface and a bottom surface. a first sidewall depending from the bottom surface proximate the first side edge and a second sidewall depending from the bottom surface proximate the second side edge substantially parallel to the first side wall, the first sidewall and the second sidewall defining a socket therebetween for slidably engaging a rail of a handguard. A snap clip is carried by the body and is movable between a raised position for allowing sliding engagement with a rail of a handguard and a lowered position wherein a portion thereof is received within a slot of the handguard and prevents sliding engagement thereof.

In a specific aspect of the invention, the body includes a snap clip aperture formed therethrough and the snap clip includes a top surface, a bottom surface, a first end and a second end. A first tab extends from the first end proximate the bottom surface, a second tab extends from the second end proximate the bottom surface, a third tab extends from the first end proximate the top surface, and a fourth tab extends from the second end proximate the top surface. A portion of the body is positioned between the first tab and the third tab, and another portion of the body is positioned between the second tab and the fourth tab.

In another aspect, the snap clip includes a retention mechanism for retaining the snap clip in the lowered position.

In yet another aspect, the snap clip includes a first portion and a second portion. The first portion is a cut-out portion of the body extending inwardly from the first side edge to a tab end and coupled to the first sidewall with a locking tab depending from the tab end. A second portion is a cut-out portion of the body extending inwardly from the second side edge to a tab end and coupled to the second sidewall, a locking tab depending from the tab end. The first portion and the second portion or pivotally movable about the first sidewall and the second sidewall, respectively, from the lowered position to a raised position. The first portion and the second portion are biased to the lowered position with the locking tab of first portion and the locking tab of the second portion positioned to be received within a slot of the rail and prevent sliding engagement thereof.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
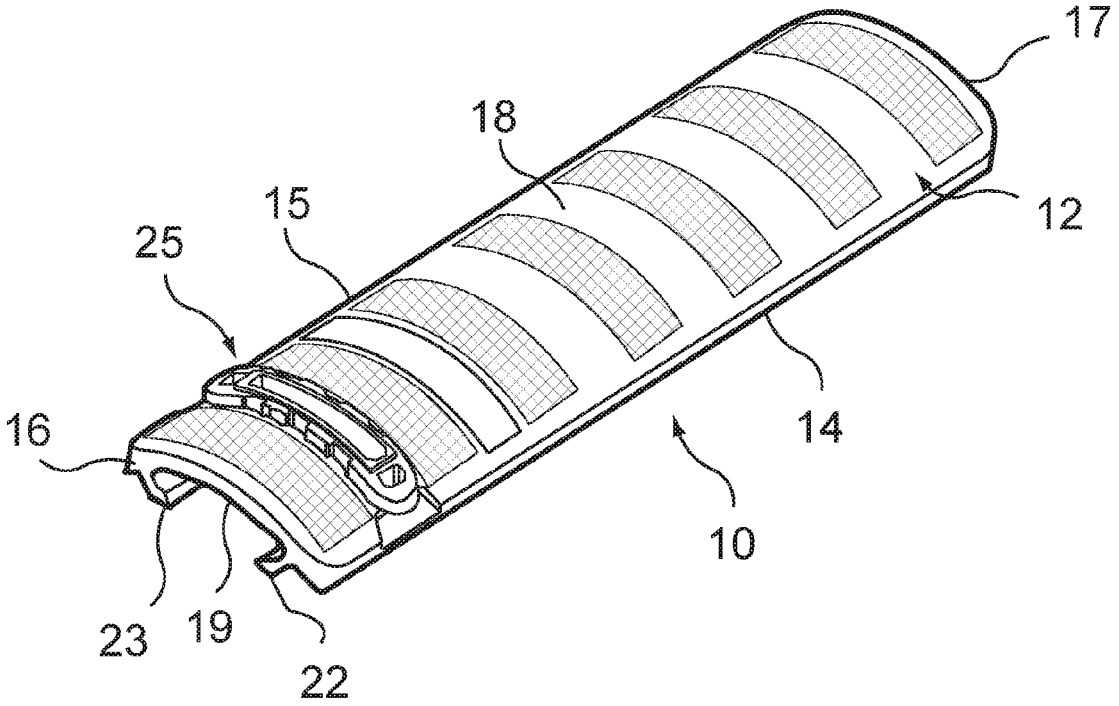
FIG. 1 is a perspective view of a firearm rail cover according to the present invention.

Turning now to the drawings in which like reference characters indicate corresponding elements throughout the several views, attention is directed to FIG. 1 which illustrates a rail cover generally designated 10. Rail cover 10 includes an elongate substantially rectangular body 12 having opposing side edges 14, 15, opposing ends 16, 17, a top surface 18 and a bottom surface 19. Body 12 is arcuate from side edge 14 to side edge 15. In this manner top surface 18 is generally convex, and bottom surface 19 is generally concave. The degree of curvature of body 12 is intended to complement the curvature of the handguard to which it is to be attached. Top surface 18 can be textured or treated as desired to provide a comfortable grip, non-slip grip or the like. Body 12 is preferably formed in a single unitary piece using a durable, heat and chemical resistant heavy duty synthetic polymer resin material.

Body 12 of rail cover 10 and the rail of a handguard form a sliding dovetail joint when cover 10 is attached to the rail. This is accomplished by forming a socket 20 at bottom surface 19 of body 12. Socket 20 is defined by inwardly hooked sidewalls 22 and 23 extending outwardly from bottom surface 19 of body 12 proximate side edges 14 and 15, respectively. Sidewalls 22 and 23 are parallel and extend substantially the length of respective side edges 14 and 15 from end 16 to end 17, with the exception of a beak therein as will be described presently. Socket 20 is preferably formed to be compatible with all 1913 Picatinny rail systems, which are a standard in the industry. It will be understood that socket 20 can be formed to accommodate other rails systems as desired, such as the Weaver type system.

Figure 2:
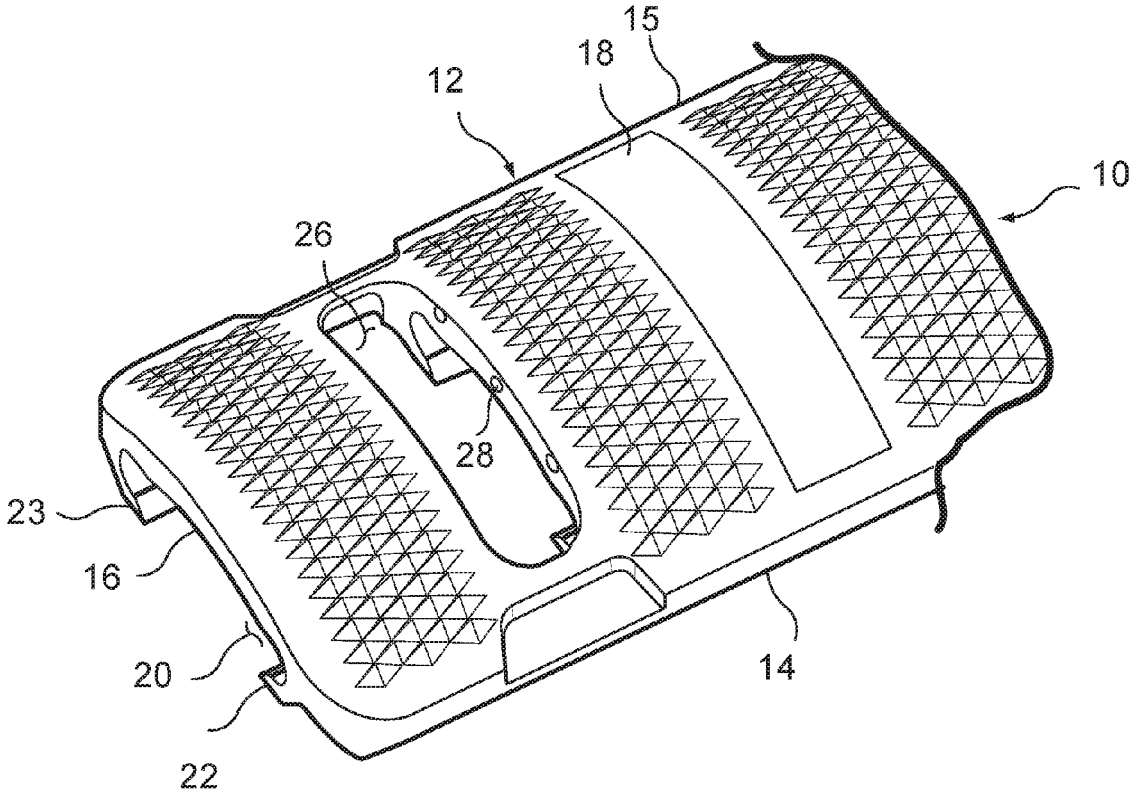
FIG. 2 is an enlarged perspective view of a portion of the rail cover of FIG. 1 illustrating the snap receiving aperture.
Figure 3:
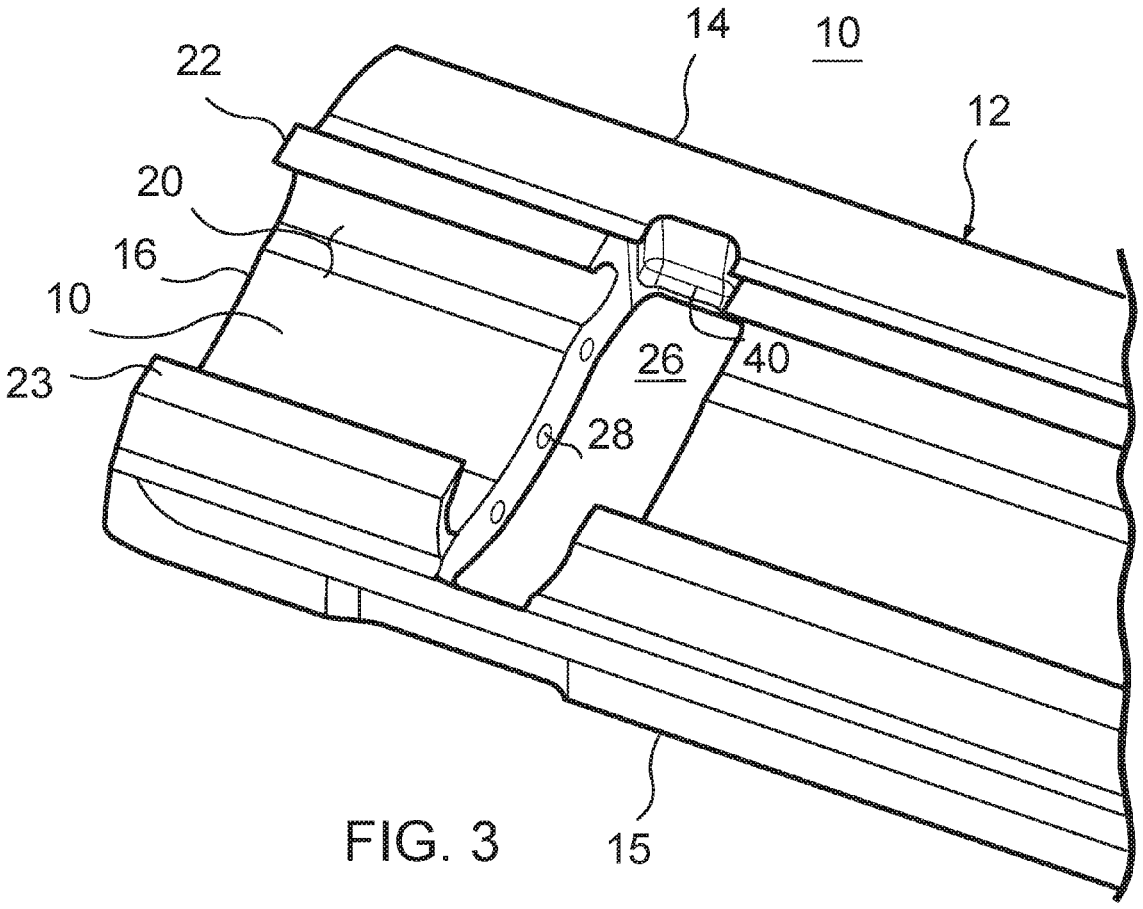
FIG. 3 is an inverted enlarged perspective view of the portion of the rail cover of FIG. 2 illustrating the snap receiving aperture.

Still referring to FIG. 1, with additional reference to FIGS. 2 and 3, rail cover 10 further includes a snap clip 25 carried by body 12 within a snap clip aperture 26 formed through body 12 proximate one end. In this embodiment, aperture 26 is formed proximate end 16, and extends across body 12 intermediate side edges 14 and 15. As can be seen with specific reference to FIG. 3, sidewalls 22 and 23 defining socket 20 are broken at aperture 26 which is formed therethrough. A plurality of indentations 28 are formed in the walls of body 12 defining aperture 26, the purpose of which will be described presently.

Figure 4:
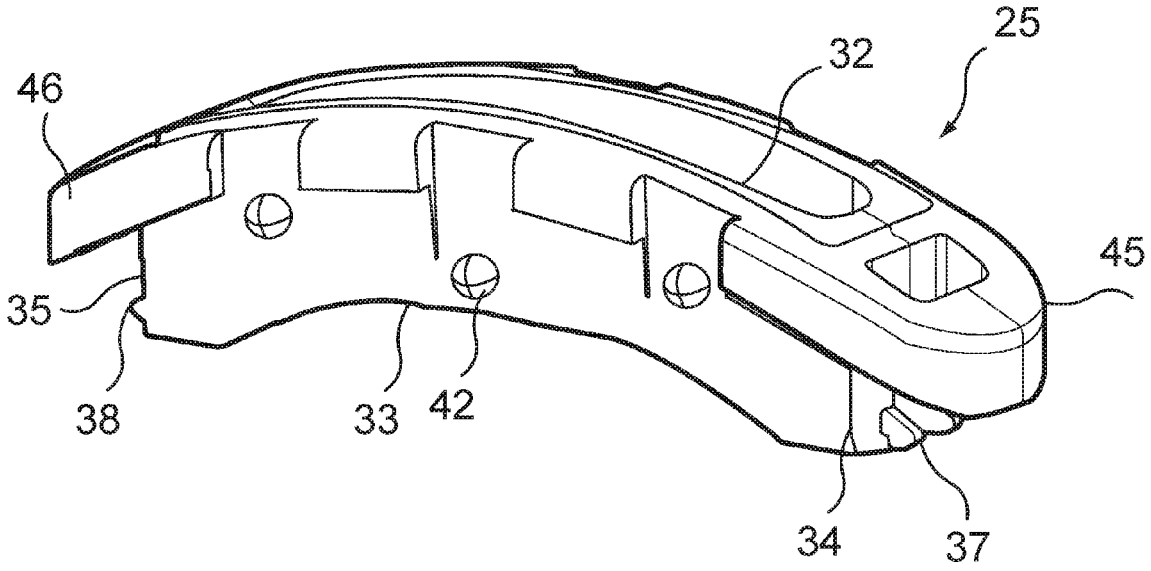
FIG. 4 is a perspective view of the snap clip, a portion of the attachment mechanism of the cover.
Figure 5:
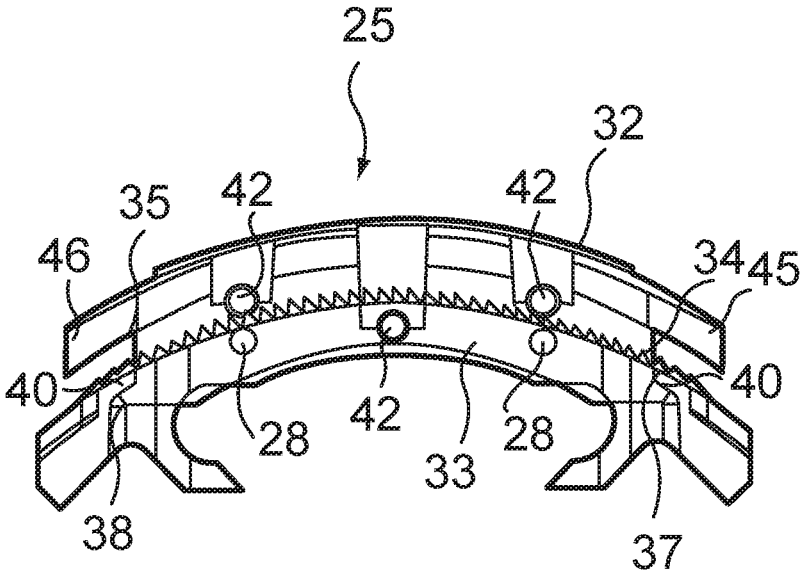
FIG. 5 is a sectional end view of the cover, illustrating the snap clip in the open or unlatched position.

Turning now to FIGS. 4 and 5, a snap clip 25 is illustrated. Snap clip 25 has a top surface 32 with curvature closely matching top surface 18 and a bottom surface 33 having a curvature closely matching bottom surface 19. Snap clip 25 is configured to be closely received within aperture 26 and includes opposing ends 34 and 35. Snap clip 25 is movable between an open or unlocked position and a closed or locked position. The open, raised or unlocked position is illustrated in FIG. 5, wherein a tab 37 and a tab 38 extending from ends 34 and 35, respectively, engage a stop 40 (FIG. 3) to hinder further upward movement. In the closed, locked or lowered position, snap clip 25 is pushed downwardly into aperture 26. Downward movement is arrested by flanges 45 and 46 contacting top surface 18 of body 12. In this position, a plurality of protuberances 42, formed from the sides of snap clip 25, are received within indentations 28. Protuberances 42 and indentations 28 interact to function as a retention mechanism to hold snap clip 25 within aperture 26 in the closed position.

Figure 6:
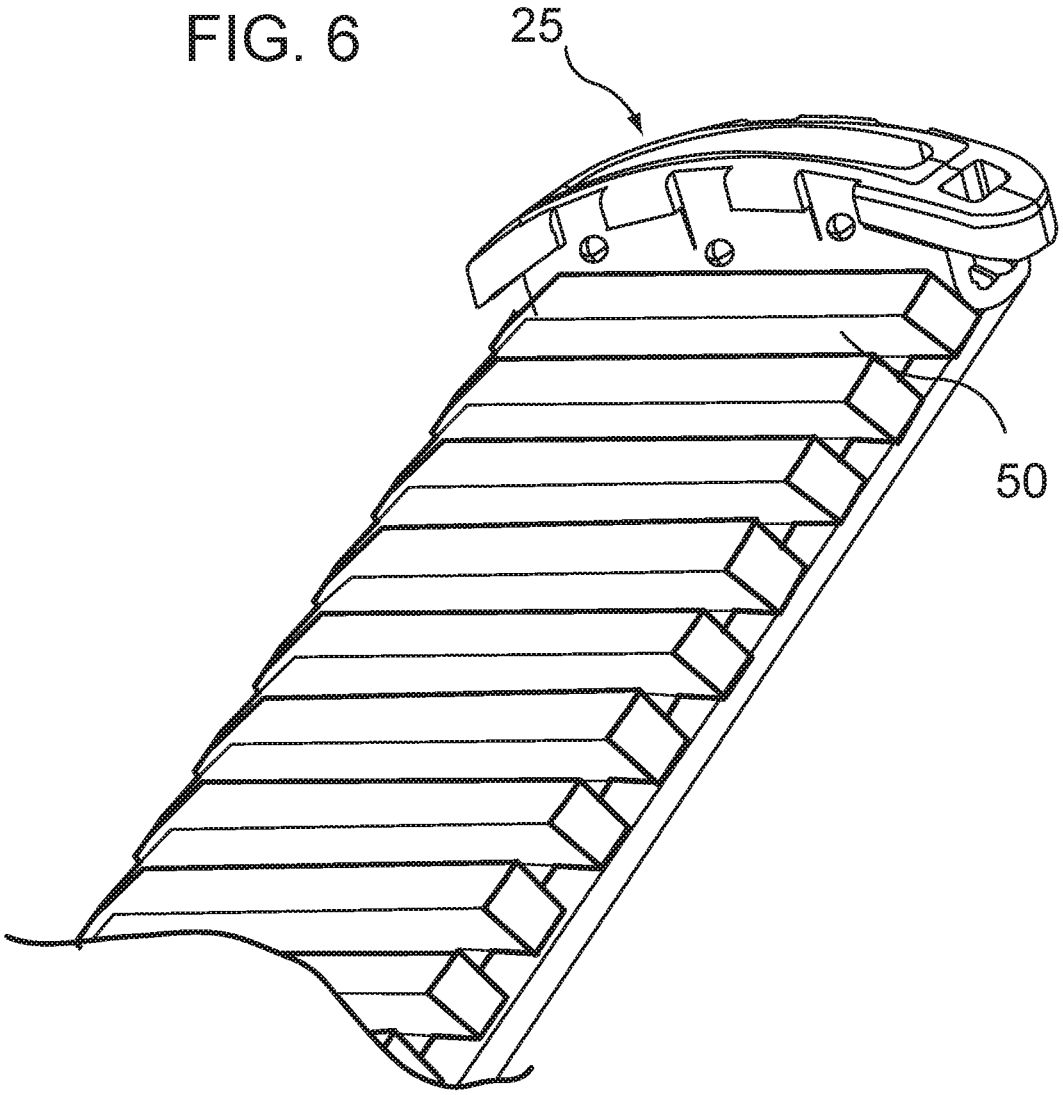
FIG. 6 is a perspective view illustrating a rail of a handguard with the snap clip in the locked or closed position in relation thereto.

With reference to FIG. 6, a rail 50 typically found on the handguard of a firearm, or other rail system, is illustrated. Rail 50 includes a plurality of flat spacing slots 52. When rail cover 10 is in position, with rail 50 received within socket 20, snap clip 25 is positioned over one of spacing slots 52 in the open or unlocked position. Upon pressing snap clip downward to the closed or locked position, bottom surface 33 is received within the aligned flat spacing slot. In this manner, rail cover is locked in position, with the sliding dovetail groove disabled by snap clip 25 blocking the sliding engagement.

Figure 7A:
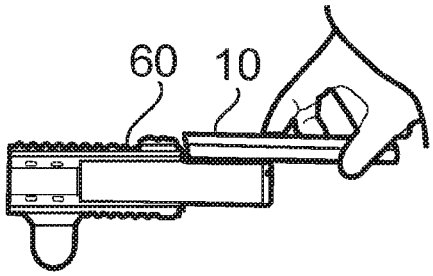
FIGS. 7A-7C are perspective views illustrating a rail cover according to the present invention being installed on the rail of a handguard of a firearm.
Figure 7B:
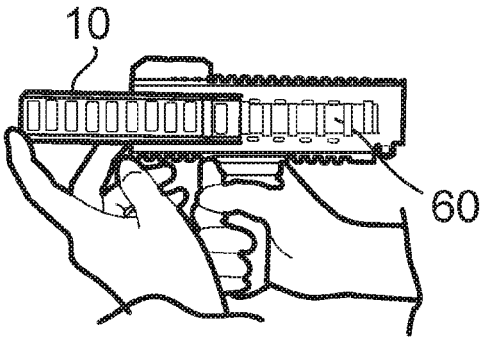
Figure 7C:
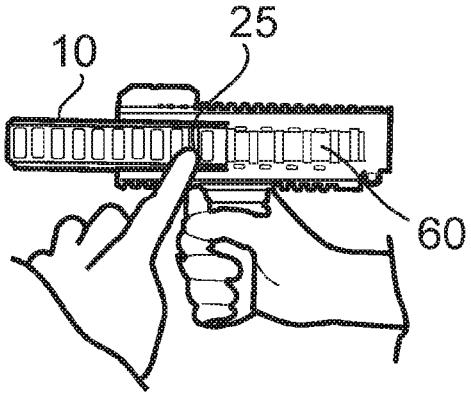

Referring to FIGS. 7A-7C, the installation of a rail cover 10 on the rail 60 of a firearm 62 is illustrated. FIG. 7A illustrates cover 10 aligned with firearm 62 such that socket 20 is positioned to be received by rail 60. In FIG. 7B, cover 10 is slidably inserted over rail 60 as permitted by the sliding dovetail joint formed by socket 20 and rail 60. Upon reaching the desired insertion location, snap clip 25 is pressed (FIG. 7C) downwardly, also can be referred to as inwardly, so as to move snap clip 25 from the open position to the closed position. In the closed position, snap clip 25 is received within a slot of the rail, locking cover 10 in position, with the sliding dovetail groove disabled by snap clip 25 blocking the sliding engagement with rail 60.

Figure 8:
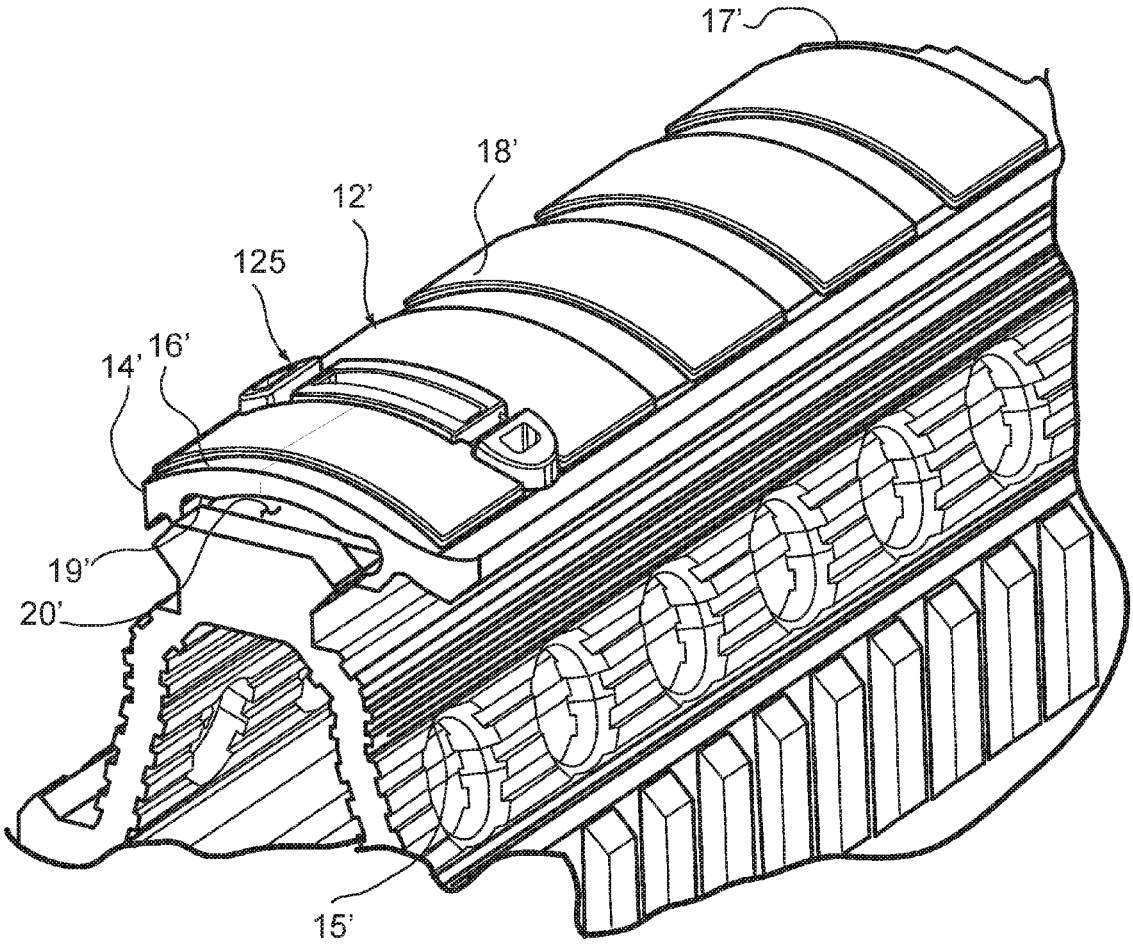
FIG. 8 is a perspective view of another embodiment of a rail cover installed on the rail of a handguard.

Referring now to FIG. 8, another embodiment of a snap clip 125 is illustrated. Snap clip 125 is employed with a body 12' that is substantially the same as body 12 described previously. The common elements will be designated with identical reference numerals, with the addition of a "'" mark on those elements associated with body 12'. Since the elements are essentially the same, they will not be described again in detail. Body 12' has opposing side edges 14', 15', opposing ends 16', 17', a top surface 18' and a bottom surface 19'. Body 12' is arcuate from side edge 14' to side edge 15'. The curvature selected is one which provides a desirable feel for use as a grip, and can closely match the curvature of the handguard on which the rail is formed, or increase or decrease the curvature, as desired. Body 12' includes a socket 20', configured to slidably engage a rail system as described previously with respect to socket 20. Body 12' also includes an aperture 26'.

Figure 9:
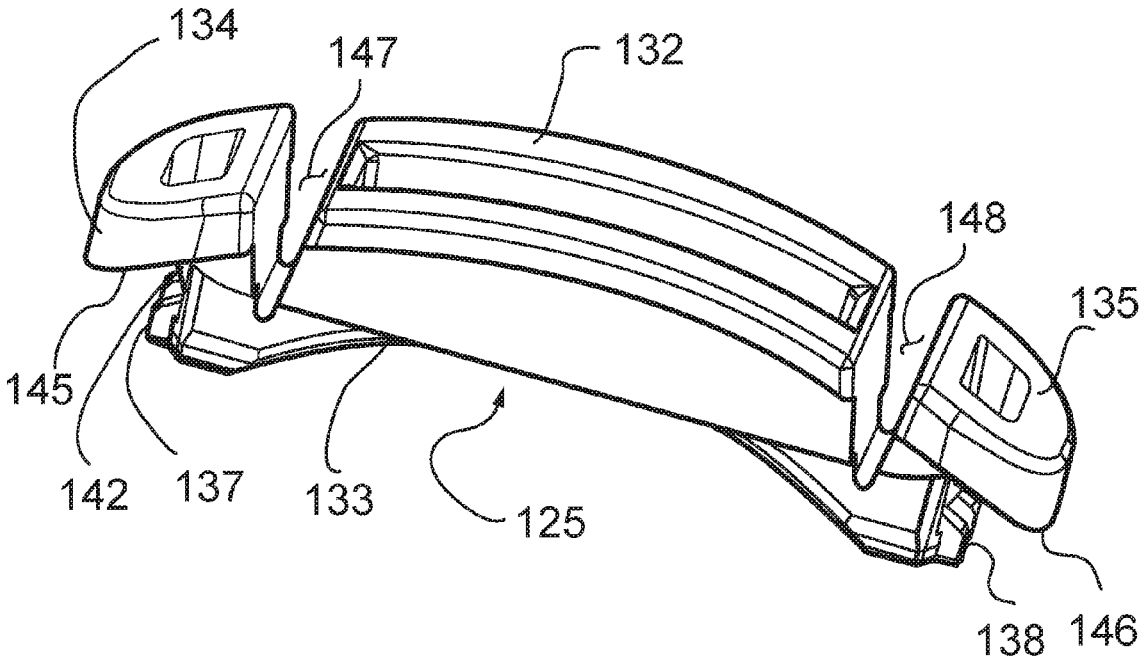
FIG. 9 is a perspective view of the snap clip, a portion of the attachment mechanism of the cover of FIG. 8.
Figure 10:
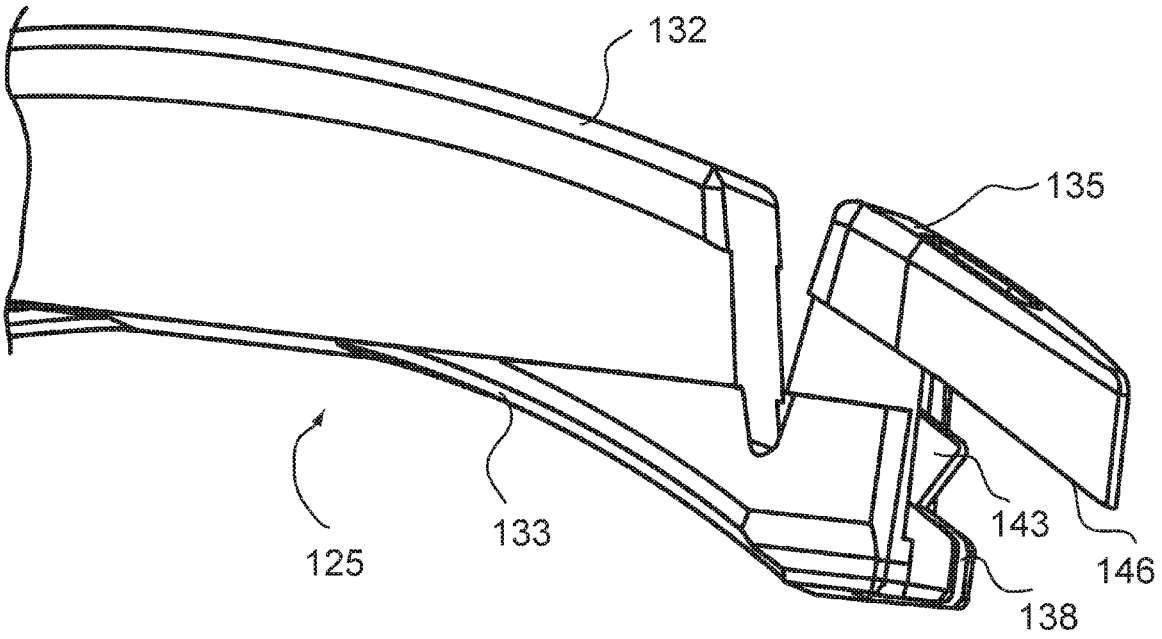
FIG. 10 is an enlarged side view of an end of the snap clip of FIG. 9.

With additional reference to FIGS. 9 and 10, snap clip 125 has a top surface 132 with a curvature closely matching top surface 18' and a bottom surface 133 having a curvature closely matching bottom surface 19'. Snap clip 125 is configured to be closely received within aperture 26' and includes opposing ends 134 and 135. Snap clip 125 is movable between an open or unlocked position and a closed or locked position. The open, raised or unlocked position is similar to that of snap clip 25, wherein tabs 137 and 138 extend from ends 134 and 135, respectively, engage a stop 40' to hinder further upward movement. In the closed, locked or lowered position, snap clip 125 is pushed downwardly into aperture 26'. Downward movement is arrested by flanges 145 and 146 contacting top surface 18' of body 12'. In this embodiment, snap clip 125 is held in the raised position and the lowered position by locking tabs 142 and 143 extending from ends 134 and 135, respectively, intermediate tabs 137, 138 and flanges 145, 146. A gap 147 and 148 are formed in snap clip 125 separating ends 134 and 135, respectively, from the main portion of snap clip 125. Ends 134 and 135 are biased outwardly by the flexibility of the material proximate bottom surface 133 where ends 134 and 135 attach. Thus, with ends 134 and 135 biased outwardly, locking tabs 142 and 143 are in an engaging or locking position. When ends 134 and 135 are forced inwardly toward one another, reducing gaps 147 and 148, locking tabs 142 and 143 are moved into the disengaged or unlocked position. In the engaged position, locking tabs 142, 143 cannot move past stop 40', while in the disengaging position they are displaced inwardly to allow passage past stop 40'. In this manner, snap clip 125 is secured in the raised position when stop 40' is captured between locking tabs 142, 143 and tabs 137, 138. Snap clip 125 is secured in the lowered position when stop 40' is captured between locking tabs 142, 143 and flanges 145, 146. Movement between the positions is permitted by pressing ends 134 and 135 inwardly. These structures act as a retention mechanism to hold snap clip 125 within aperture 26' in the closed position and the open position.

Figure 11:
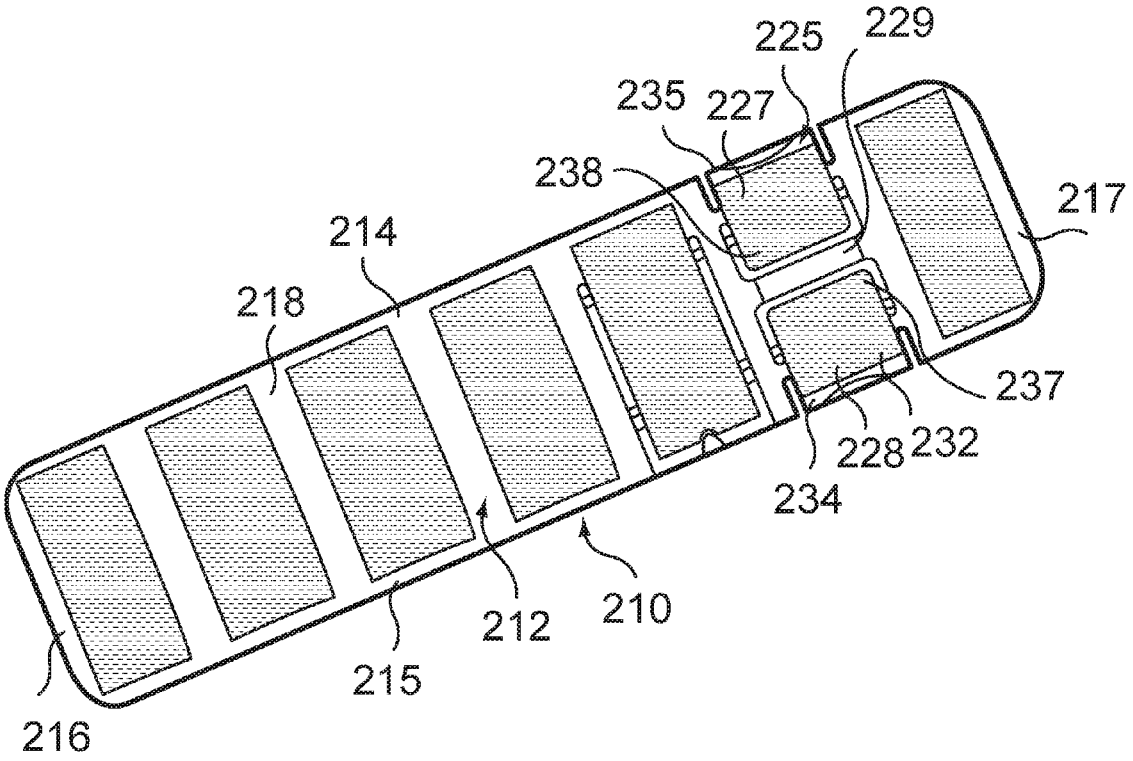
FIG. 11 is a top view of another embodiment of a rail cover according to the present invention.
Figure 12:
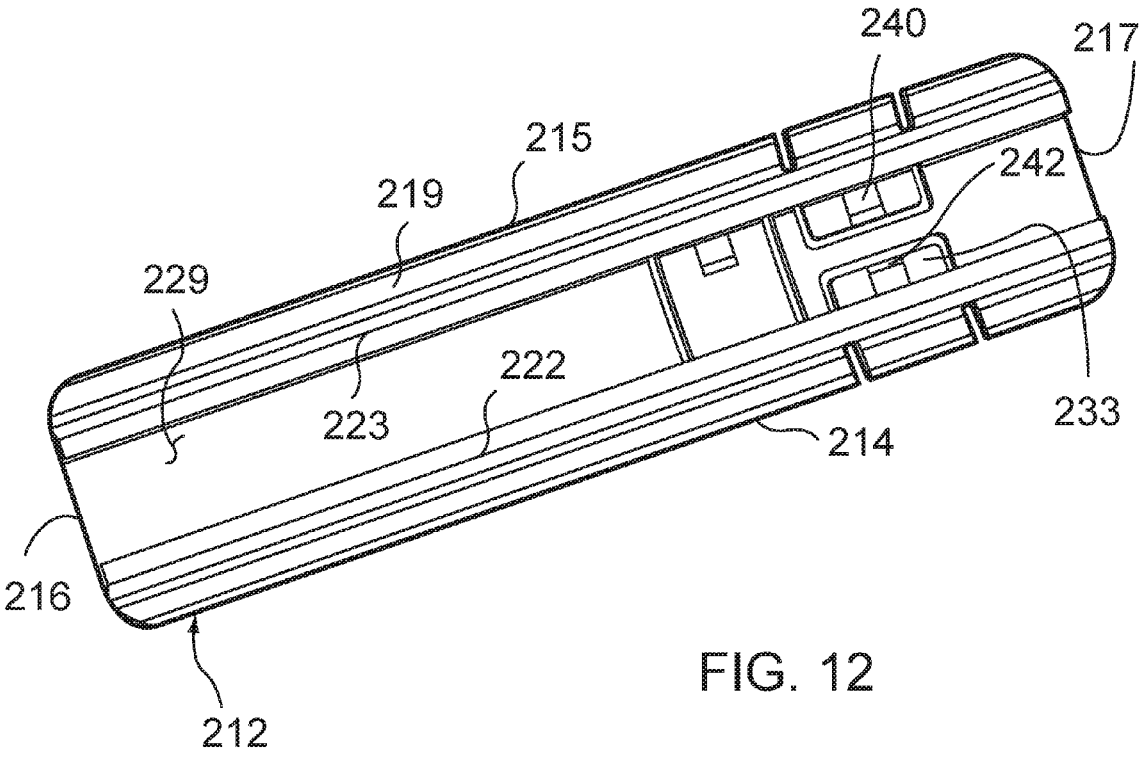
FIG. 12 is a bottom view of the rail cover of FIG. 11.

Referring now to FIGS. 11 and 12, another embodiment of a rail cover generally designated 210 is illustrated. Rail cover 210 includes an elongate substantially rectangular body 212 having opposing side edges 214, 215, opposing ends 216, 217, a top surface 218 and a bottom surface 219. Body 212 is arcuate from side edge 214 to side edge 215. In this manner top surface 218 is generally convex, and bottom surface 219 is generally concave. The degree of curvature of body 212 is intended to complement the curvature of the handguard to which it is to be attached although greater or lesser curvature can be used. Top surface 218 can be textured or treated as desired to provide a comfortable grip, non-slip grip or the like. Cover 210 is preferably formed in a single unitary piece using a durable, heat and chemical resistant heavy duty synthetic polymer resin material.

Body 212 of rail cover 210 and the rail of a handguard form a sliding dovetail joint when cover 210 is attached to the rail as shown in previous embodiments. This is accomplished by forming a socket 220 at bottom surface 219 of body 212. Socket 220 is defined by inwardly hooked sidewalls 222 and 223 extending outwardly from bottom surface 219 of body 212 proximate side edges 214 and 215, respectively. Sidewalls 222 and 223 extend substantially the length of respective side edges 214 and 215 from end 216 to end 217. Socket 220 is preferably formed to be compatible with all 1913 Picatinny rail systems, which are a standard in the industry. It will be understood that socket 220 can be formed to accommodate other rails systems as desired, such as the Weaver type system.

Rail cover 210 further includes a snap clip 225 integrally formed in body 212 proximate one end. In this embodiment, snap clip 225 is formed by two portions 227 and 228 formed of cut-out portions of body 212. Portions 227 and 228 are separated by a dividing portion 229 located central of body 212, have ends 234 and 235 corresponding to side edges 214 and 215, respectively, and opposing ends 237 and 238 positioned proximate dividing portion 229. Portions 227 and 228 are each carried by sidewalls 222 and 223, respectively, intermediate ends 234, 235 and 237, 238. Portions 227 and 228 are flexible about sidewalls 222 and 223. Each of portions 227 and 228 have a top surface 232, a sub-portion of top surface 218, and a bottom surface 233, a sub-portion of bottom surface 219. Portions 227 and 228 include a tab 240 and a tab 242, respectively, extending from bottom surface 233 proximate ends 237 and 238. Snap clip 225 is movable between an open or unlocked position and a closed or locked position. The open, raised or unlocked position occurs when ends 234 and 235 are depressed, flexing portions 227 and 228 about sidewalls 222 and 223 and raising ends 237 and 238 and tabs 240 and 242 against the bias of the normal position. In the normal position, tabs 240 and 242 depend below bottom surface 219 of body 212. In the open, raised or unlocked position, tabs 240 and 242 are raised toward top surface 218. To install or remove rail cover 210, snap clip 225 is moved to the open, raised or unlocked position by depressing ends 234 and 235 to raise tabs 240 and 242. Rail cover 210 can then by slid onto or off of a rail using the sliding dovetail created by socket 220. When positioned properly, ends 234 and 235 are release. The bias created by the flexure of sidewalls 222 and 223 moves portions 227 and 228 back to the neutral/normal position which corresponds to the closed or locked position with ends 237 and 238 moving in the opposite direction and tabs 240 and 242 lowered below bottom surface 219 and thus are received within the aligned flat spacing slot of a rail when mounted. In this manner, rail cover 210 is locked in position, with the sliding dovetail groove disabled by snap clip 225 blocking the sliding engagement.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A rail cover comprising:

a body having opposing first and second side edges, a top surface, a bottom surface, and a snap clip aperture formed therethrough;

a first sidewall depending from the bottom surface proximate the first side edge and a second sidewall depending from the bottom surface proximate the second side edge substantially parallel to the first side wall, the first sidewall and the second sidewall defining a socket therebetween for slidably engaging a rail of a handguard; and a snap clip carried by the body within the snap clip aperture and movable between a raised position for allowing sliding engagement with a rail of a handguard and a lowered position wherein a portion thereof is received within a slot of the rail and prevents sliding engagement thereof, the snap clip further comprising:

a top surface, a bottom surface, a first end and a second end;

a first tab extending outwardly from the first end proximate the bottom surface;

a second tab extending outwardly from the second end proximate the bottom surface;

a third tab extending outwardly from the first end proximate the top surface; and a fourth tab extending outwardly from the second end proximate the top surface;

wherein a portion of the body is positioned between the first tab and the third tab, and another portion of the body is positioned between the second tab and the fourth tab.

2. A rail cover as claimed in claim 1 wherein the portion of the body is a stop member extending into the snap clip aperture, and the another portion of the body is another stop member extending into the snap clip aperture.

3. A rail cover as claimed in claim 1 wherein the snap clip includes a retention mechanism for retaining the snap clip in the lowered position.

4. A rail cover as claimed in claim 1 further comprising a retention mechanism including a plurality of indentations formed in walls of the body defining the snap clip aperture, and a plurality of protuberances extending from the snap clip which are received by the indentations, in the lowered position.

5. A rail cover comprising:

a handguard having a rail with transverse slots;

a body having opposing first and second side edges, a top surface, a bottom surface, and a snap clip aperture formed therethrough;

a first sidewall depending from the bottom surface proximate the first side edge and a second sidewall depending from the bottom surface proximate the second side edge substantially parallel to the first side wall, the first sidewall and the second sidewall defining a socket therebetween, the rail slidably received in the socket; and a snap clip carried by the body within the snap clip aperture and movable between a raised position for allowing sliding engagement with a rail of a handguard and a lowered position wherein a portion thereof is received within a slot of the rail and prevents sliding engagement thereof, the snap clip further comprising:

a top surface, a bottom surface, a first end and a second end;

a first tab extending outwardly from the first end proximate the bottom surface;

a second tab extending outwardly from the second end proximate the bottom surface;

a third tab extending outwardly from the first end proximate the top surface; and a fourth tab extending outwardly from the second end proximate the top surface;

wherein a portion of the body is positioned between the first tab and the third tab, and another portion of the body is positioned between the second tab and the fourth tab.

6. A rail cover as claimed in claim 5 wherein the portion of the body is a stop member, and the another portion of the body is another stop member.

7. A rail cover as claimed in claim 5 wherein the snap clip includes a retention mechanism for retaining the snap clip in the lowered position.

8. A rail cover as claimed in claim 5 further including a retention member having a plurality of indentations formed in walls of the body defining the snap clip aperture, and a plurality of protuberances extending from the snap clip which are received by the indentations in the lowered position.

* * * * *